US008062148B1

(12) United States Patent
Farkas

(10) Patent No.: US 8,062,148 B1
(45) Date of Patent: Nov. 22, 2011

(54) GOLF PUTTER

(76) Inventor: Stephen W. Farkas, Idaho Falls, ID (US)

( * ) Notice: Subject to any disclaimer, the term of this patent is extended or adjusted under 35 U.S.C. 154(b) by 20 days.

(21) Appl. No.: 12/693,323

(22) Filed: Jan. 25, 2010

Related U.S. Application Data

(63) Continuation-in-part of application No. 12/332,143, filed on Dec. 10, 2008, now abandoned.

(51) Int. Cl.
*A63B 53/02* (2006.01)
*A63B 53/04* (2006.01)

(52) U.S. Cl. ..... 473/313; 473/314; 473/340; 473/349

(58) Field of Classification Search ..... 473/219–256, 473/340–341, 313–314; D21/736–746
See application file for complete search history.

(56) References Cited

U.S. PATENT DOCUMENTS

| | | | | | |
|---|---|---|---|---|---|
| 1,250,296 | A | * | 12/1917 | Fitzjohn | 473/313 |
| 3,333,854 | A | | 8/1967 | White | |
| 3,343,839 | A | | 9/1967 | Borah | |
| 4,165,076 | A | | 8/1979 | Cella | |
| 4,201,384 | A | | 5/1980 | Barber | |
| 4,312,509 | A | | 1/1982 | Grant | |
| 4,664,385 | A | | 5/1987 | Macera | |
| 4,815,739 | A | * | 3/1989 | Donica | 473/313 |
| 4,867,457 | A | | 9/1989 | Lowe | |
| 4,881,739 | A | | 11/1989 | Garcia | |
| D324,896 | S | | 3/1992 | Froiland et al. | |
| 5,294,122 | A | | 3/1994 | Longo | |
| 5,344,149 | A | | 9/1994 | Miller | |
| 5,348,301 | A | | 9/1994 | Ma | |
| 5,383,664 | A | | 1/1995 | Epperson | |
| 5,467,987 | A | | 11/1995 | Perkins | |
| 5,695,410 | A | * | 12/1997 | Brown | 473/305 |
| 5,718,644 | A | | 2/1998 | Donofrio | |
| 5,830,075 | A | | 11/1998 | Hirose | |
| 5,857,922 | A | | 1/1999 | Delio | |
| 5,928,088 | A | | 7/1999 | Matthews | |
| 6,001,028 | A | * | 12/1999 | Tang et al. | 473/313 |
| 6,033,319 | A | * | 3/2000 | Farrar | 473/313 |
| 6,217,459 | B1 | | 4/2001 | Purcell | |
| D444,831 | S | | 7/2001 | Bang | |
| 6,340,336 | B1 | | 1/2002 | Loconte | |
| 6,350,208 | B1 | * | 2/2002 | Ford | 473/249 |
| D460,990 | S | | 7/2002 | Jung | |
| 6,464,598 | B1 | | 10/2002 | Miller | |
| 6,520,865 | B1 | | 2/2003 | Fioretti | |
| 6,533,678 | B1 | | 3/2003 | Johnson | |
| 6,605,008 | B1 | * | 8/2003 | Kovarik | 473/329 |
| 6,623,375 | B2 | * | 9/2003 | Davies | 473/314 |
| 2002/0055395 | A1 | | 5/2002 | Douglas et al. | |
| 2006/0116216 | A1 | * | 6/2006 | Sorenson | 473/313 |
| 2007/0010349 | A1 | | 1/2007 | Johnson | |
| 2007/0111818 | A1 | | 5/2007 | Pinder | |
| 2007/0238549 | A1 | | 10/2007 | Johnson | |

* cited by examiner

*Primary Examiner* — Sebastiano Passaniti
(74) *Attorney, Agent, or Firm* — Thorpe North & Western LLP

(57) ABSTRACT

A golf putter head comprises a putter head, operable to be attached at or near an end of a putter shaft. The putter head includes an attachment interface for attachment to the putter shaft, the attachment interface defining a shaft axis with which the shaft is aligned when attached to the putter head. A front face is suitable to strike a golf ball and a rear face is oriented opposite the front face. The rear face includes a spine support, coupled to or formed integrally therewith, the spine support having a substantially continuous curvature. The spine support gradually decreases in depth, relative to the front face, across the rear face in directions orthogonal to the putter shaft axis.

17 Claims, 6 Drawing Sheets

GOLF PUTTER

PRIORITY CLAIM

This application is a continuation-in-part of copending U.S. patent application Ser. No. 12/332,143, filed Dec. 10, 2008, which is hereby incorporated herein by reference in its entirety.

BACKGROUND OF THE INVENTION

Golf is a game played by enthusiasts across the world. Of the various shots required during a typical round, putting is a particularly difficult skill to master, and one that is necessary for any aspiring golfer, as putting can have a significant affect on one's score. Proper putting requires a good understanding of any possible undulations in the surface of the "green," the conditions of the green, estimating correct distance and therefore proper striking pressure, and calculating the proper striking angle.

However, even with a good estimation of the distance to the hole and using an appropriate striking pressure, the golf ball is often not struck squarely with the "sweet spot" of the putter face, and the resultant shot can veer off-line, causing the putt to go awry.

SUMMARY OF THE INVENTION

In accordance with one aspect of the invention, a golf putter is provided that includes an elongated putter shaft and a putter head attached at or near an end of the putter shaft. The putter head can include an attachment interface for attachment to the putter shaft, the attachment interface defining a shaft axis with which the shaft is aligned when attached to the putter head. A front face is suitable to strike a golf ball and a rear face is oriented opposite the front face. The rear face includes a spine support, coupled to or formed integrally therewith, the spine support having a substantially continuous curvature: the spine support gradually decreases in depth, relative to the front face, across the rear face in directions orthogonal to the putter shaft axis.

In accordance with another aspect of the invention, a golf putter head is provided, including a putter head operable to be attached at or near an end of a putter shaft. The putter head can include an attachment interface for attachment to the putter shaft, the attachment interface defining a shaft axis with which the shaft is aligned when attached to the putter head. A front face can be suitable to strike a golf ball and a rear face can be oriented opposite the front face. The rear face can include a spine support, coupled to or formed integrally therewith, the spine support having a substantially continuous curvature. The spine support can gradually decrease in depth, relative to the front face, across the rear face in directions orthogonal to the putter shaft axis.

In accordance with another aspect of the invention, a golf putter head is provided, including a putter head, operable to be attached at or near an end of a putter shaft. The putter head can include an attachment interface for attachment to the putter shaft, the attachment interface can define a shaft axis with which the shaft is aligned when attached to the putter head. A front face can be suitable to strike a golf ball and a rear face can be oriented opposite the front face. The rear face can include a spine support, coupled to or formed integrally therewith, the spine support having a substantially continuous curvature. The spine support can gradually decrease in depth, relative to the front face, across the rear face in directions orthogonal to the putter shaft axis. The spine can support include an apex, and the spine support can gradually decrease in depth, relative to the front face, across the rear face from the apex in directions upward and downward from the apex.

There has thus been outlined, rather broadly, certain features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

Figure 1:
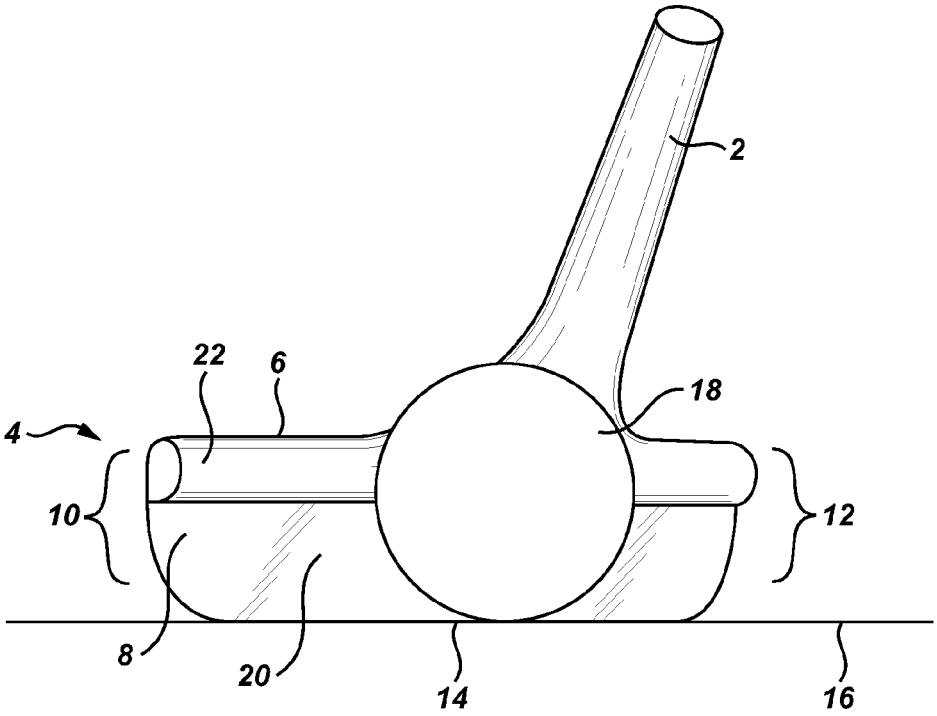
FIG. 1 is a front view of a putter head and a golf ball, in accordance with one embodiment of the invention.

The drawings will be described further in connection with the following detailed description. Further, these drawings are by way of illustration only such that dimensions and geometries can vary from those illustrated.

DETAILED DESCRIPTION OF THE PREFERRED EMBODIMENT(S)

Reference will now be made to the exemplary embodiments of the present invention, both those described and those illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

In describing and claiming the present invention, the following terminology will be used.

The singular forms "a," "an," and "the" include plural referents unless the context clearly dictates otherwise.

The term "about" when referring to a numerical value or range is intended to encompass the values resulting from experimental error or differences in perception that can occur when taking measurements.

As used herein, the term "continuous curvature" is to be understood to refer to a surface that changes only through smooth curves: no flat or planar surfaces are included in a surface with a continuous curvature, and no angled changes in topography are included in a surface with a continuous curvature.

The terms "strike" and "putt" are used interchangeably herein to indicate an action in which a putter contacts a golf ball in order to propel the golf ball. These terms can include any and all contact sufficient to propel the golf ball away from the putter. As such "striking" and "putting" can include tapping, contacting, hitting, and other terms that denote contact between a putter and a golf ball. In one use, the term "putting" can be used to indicate a standard golf putt wherein the golf ball maintains at least limited contact with the putting surface after being contacted by the putter.

"Putting surface" indicates the surface upon which a golf ball rests and is contacted by a club. Typically, the putting surface is a ground surface in the form of a putting green: however, any surface can be utilized.

When describing a club, directional terminology may be used, and is consistent with the art. When addressing a ball, the "top" of a putter head is the top surface viewed when a user looks down upon the club. The "sole" or "bottom surface" of the putter head is the surface nearest the ground. The "toe" of the club is the region of the putter head laterally furthest from a golfer, and may indicate a region or a single surface, such as a surface generally perpendicular to the top and sole of the club face. The "heel" of the club is the region of the putter head laterally nearest the golfer. Like the toe, the heel can indicate a region of the putter head or can indicate a single surface generally perpendicular to the top and sole of the club face and opposite the toe. The "face" or "putter face" or "front face" of the club head is the surface configured for striking a golf ball and is generally perpendicular to, or slightly angled from, the sole of the club. The "rear" of the club head is the surface or region opposite the face of the club and away from a golf ball. Directional descriptions such as forwardly and rearwardly are used to indicate direction towards or away of a golf ball (or the position a golf ball would be when the club addresses the ball). Forwardly indicates towards the ball, rearwardly indicates away from the ball in the direction of the rear of the club head.

Unless otherwise indicated, descriptions of a putter and putter face may rely on directional terms, and in such cases, the putter is understood to be arranged in a position addressing a ball or in a manner that would be addressing a ball, wherein a bottom surface of the putter is at least partially resting on or hovering slightly above a ground surface.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

In accordance with one aspect of the invention, a golf putter, as illustrated generally in FIG. 1, can be provided that includes an elongated putter shaft 2. The shaft can be consistent with putter shaft shapes, lengths, and materials typically known in the art. As with many putter shafts, the shaft 2 can be a solid or a hollow elongated cylinder or rod. One end of the putter shaft can be configured to provide a grip interface for a golfer, and can include materials to enhance the grip interface. The gripping materials can include, without limitation, material with substantially continuous surfaces, surfaces with conformities formed therein, and other shapes, as are known in the art.

Figure 4:
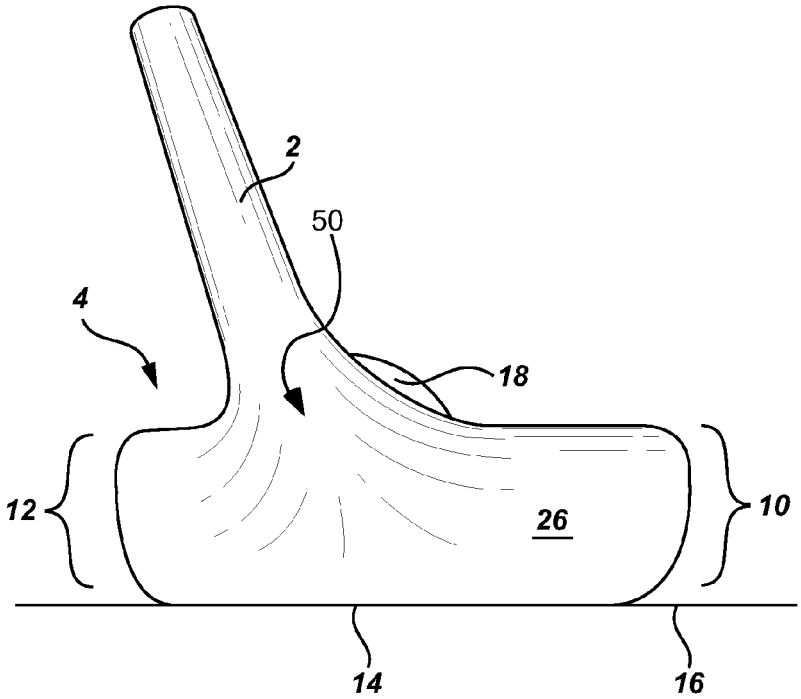
FIG. 4 is rear view of the putter head and the golf ball, in accordance with one embodiment of the invention.
Figure 5:
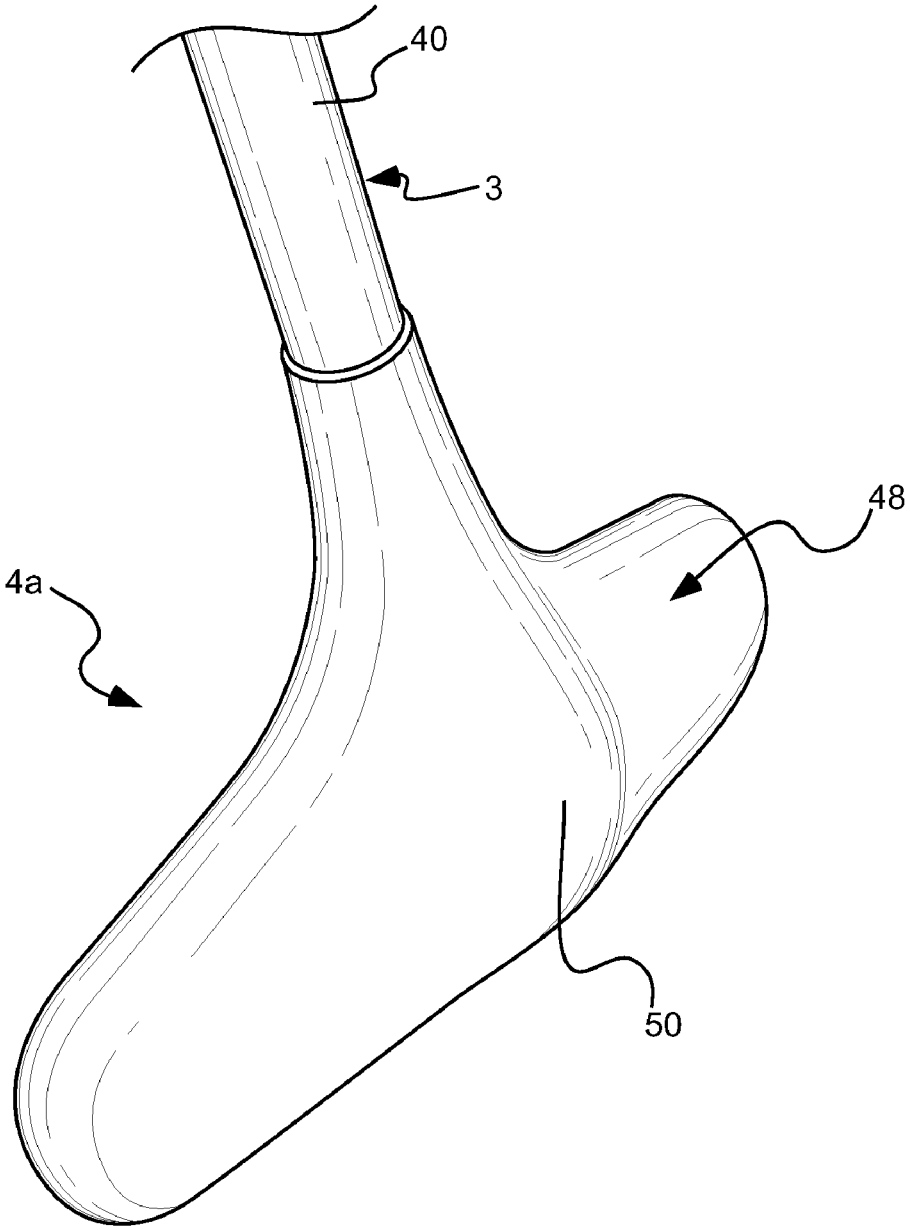
FIG. 5 is a rear perspective view of another embodiment of the invention.

The putter shaft can optionally include a neck or socket region. For example, the area of the shaft illustrated at 2 in FIG. 1 can be a neck or socket configured for coupling with an elongated rod-like portion of the shaft. Regardless of the presence of a neck or socket, on the distal end of the shaft (the end illustrated in FIG. 1), a putter head 4 can be attached. In one aspect, the neck or socket or elongated shaft attached to the putter head can be arranged at an angle of about 10° to about 30° from vertical. In a further embodiment, the putter head can be arranged at an angle of about 20°, as illustrated in FIGS. 1 and 4. As shown, the angling can be towards an area where a golfer would typically stand to utilize the club.

The putter head 4 can include a top surface 6, a face 8, a rear surface (not shown in FIG. 1), a toe region 10, a heel region 12, and a bottom surface or sole 14. As shown, the top surface 6 can extend generally parallel to, but spaced apart from, the sole, and likewise a ground surface 16. The bottom surface or sole 14 of the putter head can be suitable to move above or along a putting surface and is generally parallel to the ground surface.

It should be noted that the sole or bottom surface can include a variety of typical surface configurations that enable use of the club to strike a golf ball 18. As such, the sole can be rounded, can be flat and parallel with the ground surface, can be patterned or can have a non-planar surface configuration, etc., as would be appreciated by one of ordinary skill in the art having possession of this disclosure.

The various putters and putter heads illustrated herein are generally configured for use by a right-handed golfer: as such, the golfer will typically be positioned behind the heel 12 of the club (e.g., to the right of the club as presently illustrated in FIG. 1). The toe 10 of the club will typically be positioned furthest from the golfer. It should be noted that clubs can be left-handed and have an inverse- or mirror-image configuration from that shown in FIG. 1. In such cases, the spatial relationship between the golfer and the heel of the club will remain substantially the same.

The putter face 8 can include a ball contact ledge 22 extending forwardly from the putter head, and a lower region including a relief section 20 extending rearwardly into the putter head. As illustrated, the ball contact ledge can be a rounded ledge that extends from the top surface 6, outward into a curved forwardmost point, and returning to transition into relief section 20 of the lower region of the front face. The relief section can extend further rearwardly from the forwardmost portion of the ball contact ledge. Generally, the ball contact ledge has a forwardmost portion elevated at least about 1 inch above the bottom surface 14 of the putter head. The relief section, then, extends rearwardly from the forwardmost portion of the ball contact ledge by at least about ⅛ of an inch. As shown, the ball contact ledge can be a rounded ledge generally extending continuously from the heel 12 to the toe 10 of the club head 4.

In alternate embodiments, the ball contact ledge can extend only a partial distance between the heel and toe of the club head. In still other embodiments, the ball contact ledge can extend from the relief section, and not extend into the top surface. In such cases, the ball contact ledge can include a rounded projection extending from the planar surface.

As noted, the putter face 8 can include a relief section 20 that, as illustrated, is substantially planar. The relief section can optionally be of any shape and design that allows rearward extension from the ball contact ledge in a manner so as to prevent or limit contact between this lower section of the putter and a golf ball during a putt. In one aspect of the invention, the relief section extends rearwardly beneath the ball contact ledge and into the putter face to define an open area below the ball contact ledge, as is illustrated by example in FIG. 1. The open area, in one aspect, can have a depth of at least about ⅛ of an inch (e.g., about ⅛ inch clearance between the forwardmost portion of the ball contact ledge is provided). Where the relief section is a substantially planar, the substantially planar surface can be generally or substantially perpendicular to a putting surface 16. As illustrated in FIG. 1, the relief section of the club face is substantially perpendicular to the ground surface. Alternatively, the planar region of the putter face can be inclined so as to form an acute angle with the ground surface in the direction of the ball 18. By inclining the planar surface, the club can have a wider range of motion for accurately hitting a golf ball, as will be explained further.

Figure 2:
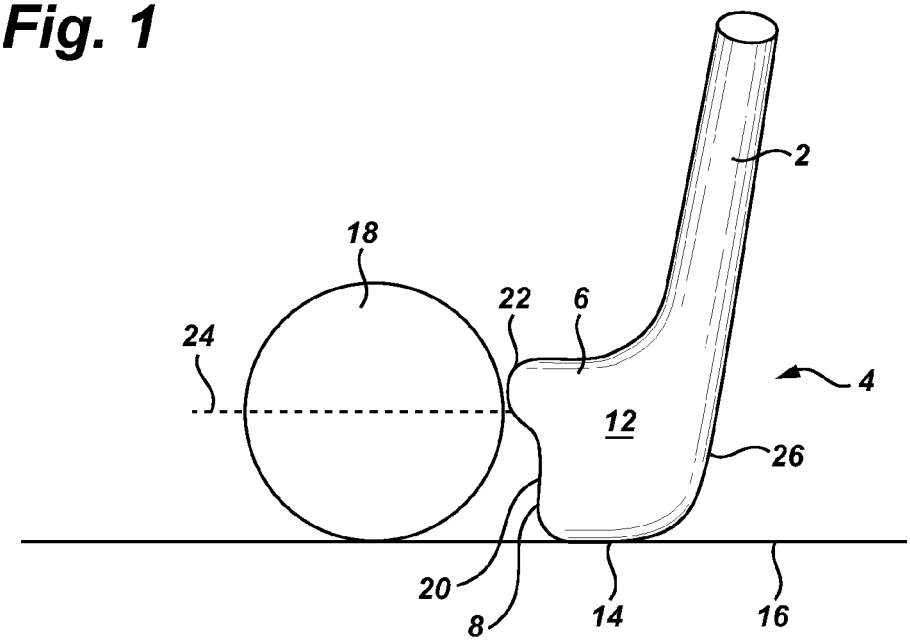
FIG. 2 is a side view of the putter head and the golf ball of FIG. 1, in accordance with one embodiment of the invention.

The ball contact ledge 22, in the form of a rounded ledge is shown at a side angle in FIG. 2. It should be noted that FIGS. 1-4 illustrate various angles of the same putter head and thus numerical references and associated descriptions are likewise applicable and incorporated herein. FIG. 2 shows the club from a viewpoint directed through the heel 12. As shown, the ball contact ledge extends away from the planar region 20 of the face 8 of the club head 4 (alternately, the planar region 20 can be perceived as extending into the club, away from the contact ledge).

The ball contact ledge, or rounded projection, should extend from the club face a distance and at a height so as to strike a golf ball 18 above the equator 24, or center line, of the ball, and thus, strikes the golf ball in an upper hemisphere. Each rounded ball, such as a golf ball, has an equator that divides the ball into two hemispheres of the same size. If the equator of the ball is at least roughly horizontal, an upper and a lower hemisphere are defined. Standard golf balls are 1¾ inch in diameter. Therefore, the equator of a standard golf ball is ⅞ inch above the ground. In one aspect, the ball contact ledge can extend a distance of about ⅛ inch to about ⅜ inch from the putter face. In one embodiment, the top surface 6, can have a height greater than about 1 inch.

In a further embodiment, the top surface has a height greater than about 1⅛ inch. The rounded ledge or rounded projection can have a variety of shapes, provided it is operable to strike a golf ball at an upper hemisphere thereof. Non-limiting examples of shapes for the ball contact ledge include horizontal cylinder, rod, round cross section, circular cross section (with a radius embedded or virtually embedded in the body of the club head), triangular cross section, rhomboidal cross section with rounded edges, etc. As the size and shape of the ball contact ledge can vary, so can the size of the ledge with respect to the face of the club. In one aspect, the ball contact ledge can occupy less than about 40% of the height of the putter face. In a further embodiment, the ball contact ledge can occupy less than about 35% of the height of the putter face.

The junction or transition region from the ball contact ledge to the relief section can be smooth and slightly curved, as illustrated in FIG. 2. Furthermore, the ball contact ledge can be arranged at a variety of angles with respect to the ground surface. In the example shown in the figures, the ball contact ledge is substantially horizontal, or parallel to the putting surface when the club is addressing a golf ball. The rounded projection or rounded ledge can be formed of the same materials utilized in the body of the club head; or, the rounded projection or rounded ledge can be a different material than the material of the body of the club head. The rounded projection or rounded ledge can be solid or hollow, and where solid, can be filled with a different material than the outer shell of the projection or ledge. The rounded ledge or projection can be formed as an integral part of the club head, or can be coupled thereto.

The shape and design of the putter face can vary greatly, depending on particular applications. In one aspect, transitions from various regions of the club head to other regions can be smooth and rounded, as is illustrated in the figures. In another aspect, the ball contact ledge can connect to and project from a putter face in a visibly distinct manner. The surface of the ball contact ledge and/or the relief section can optionally include surface variations in both coloring and roughness. In one aspect, the face of the club can be substantially free of grooves.

Figure 3:
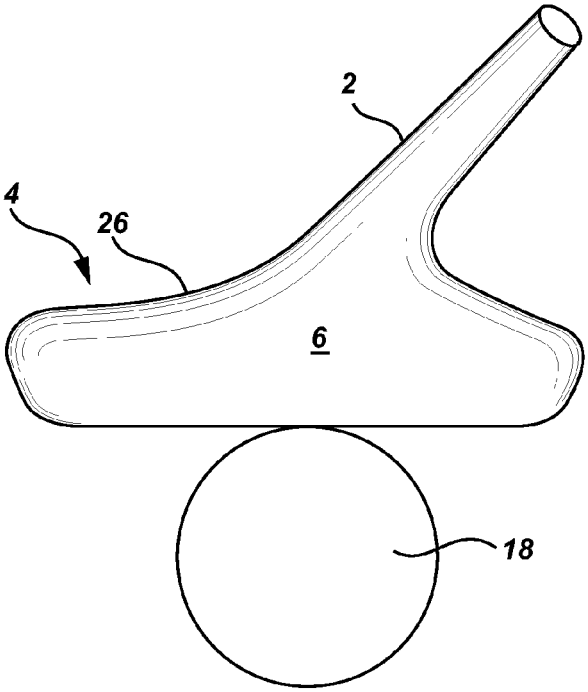
FIG. 3 is a top view of the putter head and the golf ball of FIG. 1, in accordance with one embodiment of the invention.

The putter shaft can be attached to the putter head in a variety of manners. In one aspect, the putter shaft extends along a majority of a height of the back of the putter head and is smoothly attached thereto. As illustrated in FIGS. 2-4, the shaft 2 can meet with the club head 4 at the rear of the top surface 6, so as to be visible along the height of the back of the face 26. The shaft is visibly elevated from, yet firmly attached to the back. Proper balance of clubs is desirable as it allows for better club handling, better control, and improved accuracy when striking a ball. As such, the putter shaft, and attachment thereof to the back of a club face, can be optionally configured to weight-balance the front face and more specifically the ball contact ledge of the front face.

In a specific embodiment, a golf putter head can include a putter face generally perpendicular to a ground surface. The putter face can include a planar portion forming greater than about half of a height of the putter face, and a ball contact ledge extending from the planar portion and configured to contact a golf ball at an upper hemisphere of the golf ball. The generally perpendicular putter face can form a relief section with regards to the forwardly extending ball contact ledge.

In this embodiment, as well as with the various embodiments described above, a putter can be utilized to contact a ball in a manner that directly induces rolling. Generally, when a ball is hit in the lower hemisphere or at the equator, the ball has a tendency to initially slide, skip or skid from the immediate force propelling the ball upwardly and forwardly. By using the present putter, the upwardly-directed component of the force is reduced or eliminated due to restriction of contact with the ball in the upper hemisphere thereof. Furthermore, by utilizing a ball contact ledge, the ball can have an extended contact time during a slow putting swing. Specifically, a ball is contacted above an equator thereof and as the club moves forward in a pendulum or semi-pendulum swing pattern, the ball and club each rotate while maintaining, briefly, contact.

For this reason, it is additionally important to include a relief section extending rearwardly in the putter face design, as it allows for club contact with the ball contact ledge while preventing contact with the relief section. In this manner the surface of the projection is used to further induce the ball to a rolling start. The contact, in this manner, also remains in an upper hemisphere of the ball. For embodiments relying on a larger putting stroke, it can be useful to have an extended relief section, such as an inclined planar region of the face so as to limit contact with the ball and the planar region.

The exact dimensions and shape of the putter head can vary according to the various applications and design considerations. In one aspect, the club can extend about 1¼ inches above the ground surface. The sole of the club can be configured to rest along a ground surface. A ball contact ledge can be the uppermost region of the putter face and can be in the shape of a partial rod situated horizontally along the face from the toe to the heel. The rod can be solid and can have a radius of curvature of ⅜ inch, with the centerline of the rounded projection being about 1 inch above the ground. Such arrangement acts to strike a golf ball above the equator thereof and induce an immediate roll, and thus improves accuracy.

Furthermore, the use of a ball contact ledge increases the likelihood that a golfer will properly strike the golf ball above an equator thereof. Such is not the case with clubs having only an inclined face. The present design allows for extended contact between the putter face and a portion of the golf ball situated above the equator of the ball. Inclined faces may be angled so as to initially meet the ball above an equator thereof, however, if the swing is slow, as most putting swings are, any extended contact, or multiple contacts with the ball during the swing, will likely be at or below the equator of the ball, which has a tendency or likelihood of skipping or sliding the ball.

Additionally, the club of the present design is easy to use, and does not cause unnecessary concern for a golfer. The club is configured to be held and swung as a normal putter. The ball contact ledge is designed in a manner that will not cause a golfer discomfort or disorientation as he or she attempts to hit the ball in a manner that is different than conventional putters. The smooth lines and attachment points of the ball contact ledge and/or putter shaft are pleasing to the eye and assist a golfer's comfort in handling and swinging.

It should be further noted that examples of precise measurements are based on American standard golf balls, and such measurements can be adjusted proportionally to other golf systems, for example, European standard golf balls are typically smaller than American golf balls. Furthermore, the club measurements could be likewise adjusted to meet any ball size, regulation or otherwise, if desired.

The embodiments shown in the figures are free of grooves. It should be noted, however, that grooves and/or markings along the club head can be optionally included. Alternatively, the putter head can be free from both grooves and markings.

Any material that can adequately form, either by itself or in combination with another material as a mixture, composite, alloy, etc., a golf putter having a ball contact ledge can be utilized. Non-limiting examples of materials that can be used alone or in combination include metals and plastics. Further non-limiting examples of materials that can be used alone or in combination include aluminum, brass, steel, etc. In one aspect, the ball contact ledge can comprise or be composed of a material that is harder and/or more wear-resistant than the face and/or the body of the putter head. The shaft and/or neck can be made of steel, wood, fiberglass, or any other material known in the art. The grip can be of leather, rubber, plastic or any other material known in the art. Some materials, however, may be preferred based on desired weight, cost factors, tournament rules, ease of manufacture, and even comfort and feel for the golfer. Furthermore, the putter, or any portion thereof, can optionally be coated in any number of coating agents.

Turning now to FIGS. 5-10, the discussion will focus primarily on the rear face of the putter 4 (indicated in these figures as putter 4*a*). In this aspect of the invention, a golf putter 3 can be provided that can include an elongated putter shaft 40 and a putter head 4*a* attached at or near an end of the putter shaft. The putter head can include an attachment interface 42 for attachment to the putter shaft. The attachment interface can define a shaft axis (see, e.g., 44 in FIGS. 6, 8 and 10) with which the shaft is aligned when attached to the putter head.

The putter head 4*a* can include a front face 46 that can be suitable to strike a golf ball and a rear face 48 that is oriented opposite the front face. The rear face can include a spine support 50 that can be coupled to or formed integrally with the rear face of the putter head. The spine support serves to balance the putter to effectively enlarge the "sweet spot" of the putter by reducing twists or misalignments of the putter face in the event a golf ball is struck off center.

Figure 6:
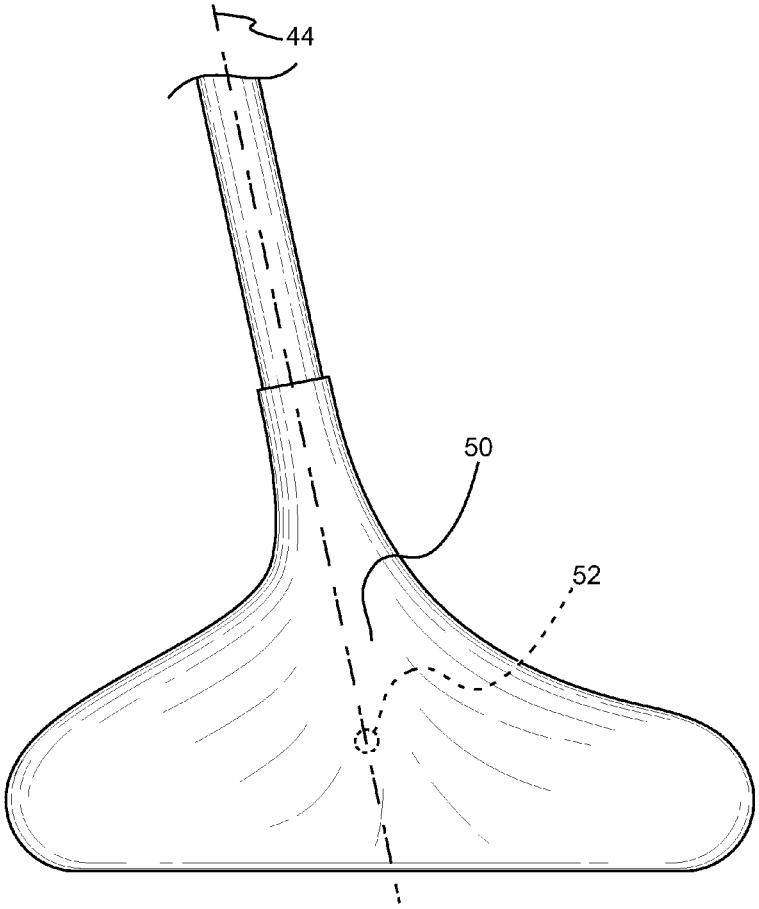
FIG. 6 is a rear plan view of the embodiment of FIG. 5.

In the embodiment shown, the spine support 50 includes a substantially continuous curvature that generally peaks at an apex 52 (shown generalized in FIG. 6—note that this representation may or may not accurately depict the exact geometric positioning of the apex for all embodiments of the invention). The curvature of the spine support smoothly transitions away from the apex toward the heel 12 and toe 10 of the putter. In other words, in one aspect of the invention, the spine support gradually decreases in depth, relative to the front face, as measured moving across the rear face in directions orthogonal to the putter shaft axis. This relationship is best appreciated from viewing FIG. 7, which shows the changes is depth of the spine support, depending upon the lateral position at which the depth is evaluated.

In addition to decreasing in depth relative to the front face from toe to heel, the spine support can also smoothly or gradually decrease in depth, relative to the front face, across the rear face from the apex in directions upward and downward from the apex. This relationship can best be appreciated by viewing FIGS. 9 and 10, which show the changes in depth of the spine support, depending upon which vertical position the depth is evaluated.

In these embodiments, the spine support 50 is generally concave along all points extending across the rear face radially outward from the apex 52. While not so required, the apex can include a smooth, rounded peak.

Figure 7:
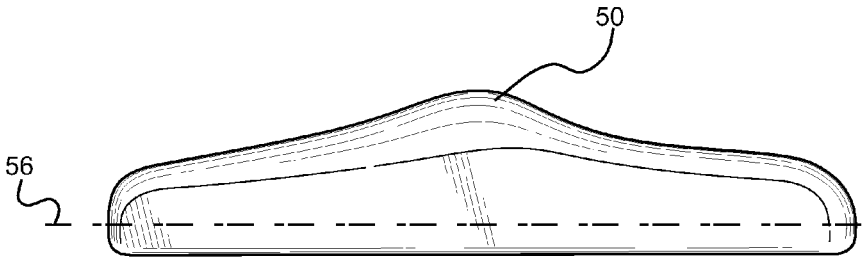
FIG. 7 is a bottom plan view of the embodiment of FIG. 5.

In one embodiment of the invention, best appreciated from FIG. 7, substantially all of the spine support is disposed rearward of a plane (shown generalized at 56) that is oriented parallel to the front face and collinear with the shaft axis (e.g., in one aspect, shaft axis 44 lies in the plane 56). In this manner, substantially all of the weight or depth distribution differences provided by the spine support are provided behind the shaft interface. Thus, substantially all of this weight is behind the shaft and serves to propel the shaft (once provided with momentum by the player) through contact with the golf ball.

Described another way, the plane 56 can represent a weight distribution plane that is defined parallel to and collinear with the shaft axis. In this case, an overall depth of the putter head can be substantially constant from heel to toe of the putter forward of the weight distribution plane (e.g., the area represented at 60 in FIG. 7), and gradually increases from the heel of the putter to the apex and gradually decreases from the apex to the toe of the putter rearward of the weight distribution plane (e.g., the area represented at 62 in FIG. 7).

As described above, the spine support 50 can aid in balancing the putter 4*a* to limit or restrict twisting or misalignment of the putter during putts in the event the golf ball is struck slightly off-center from a nominal strike. The effectiveness of the spine support is increased by the spine support curvedly reducing in depth symmetrically about the shaft axis (in the lateral directions), and symmetrically about the vertical point of contact (in the vertical direction). Thus, in one embodiment, the apex 52 corresponds to, and is opposite, the so-called "sweet spot" of the putter.

Figure 8:
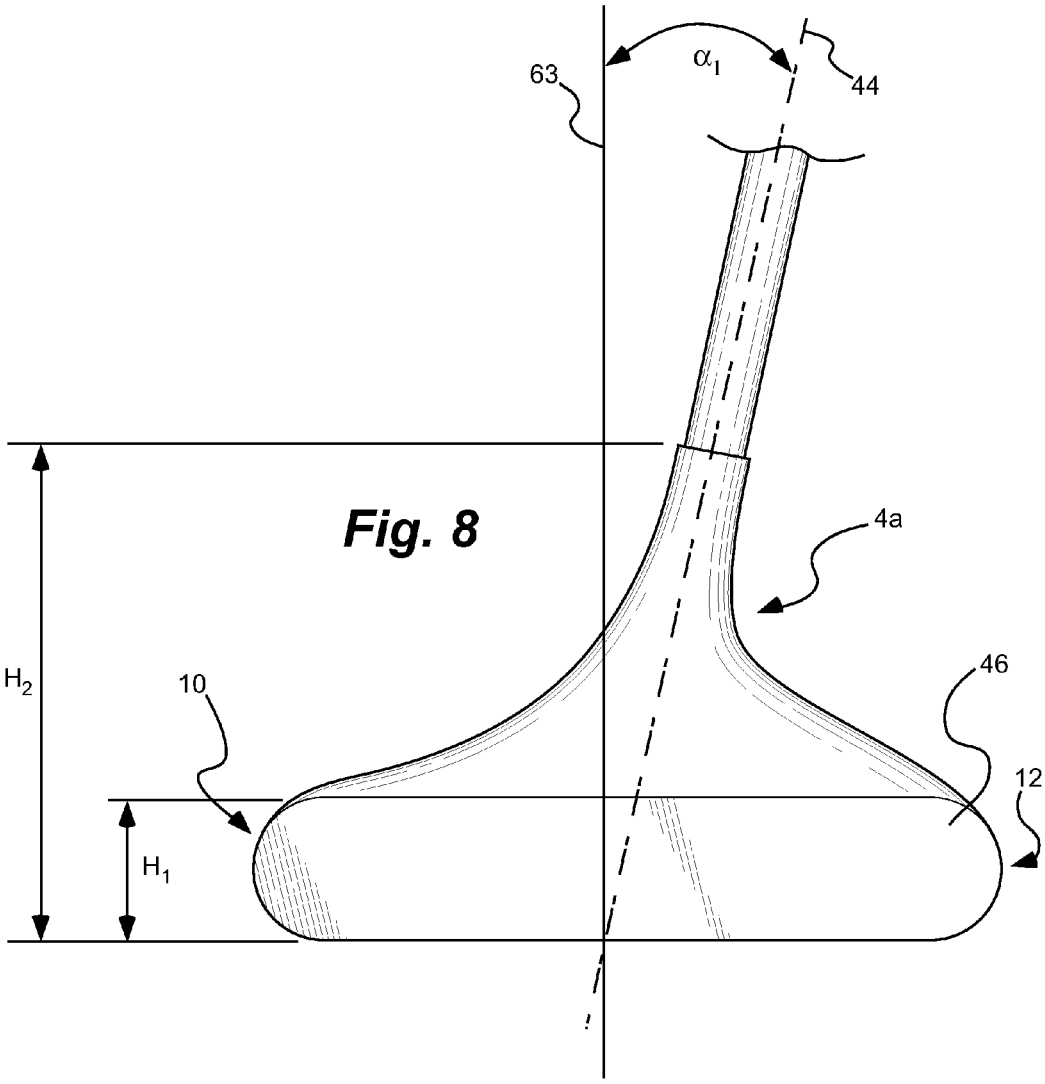
FIG. 8 is a front plan view of the embodiment of FIG. 5.
Figure 9:
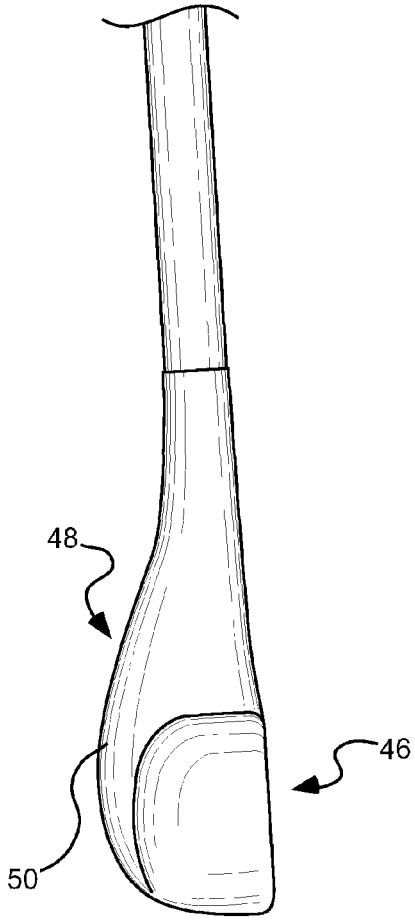
FIG. 9 is a toe-end view of the embodiment of FIG. 5.
Figure 10:
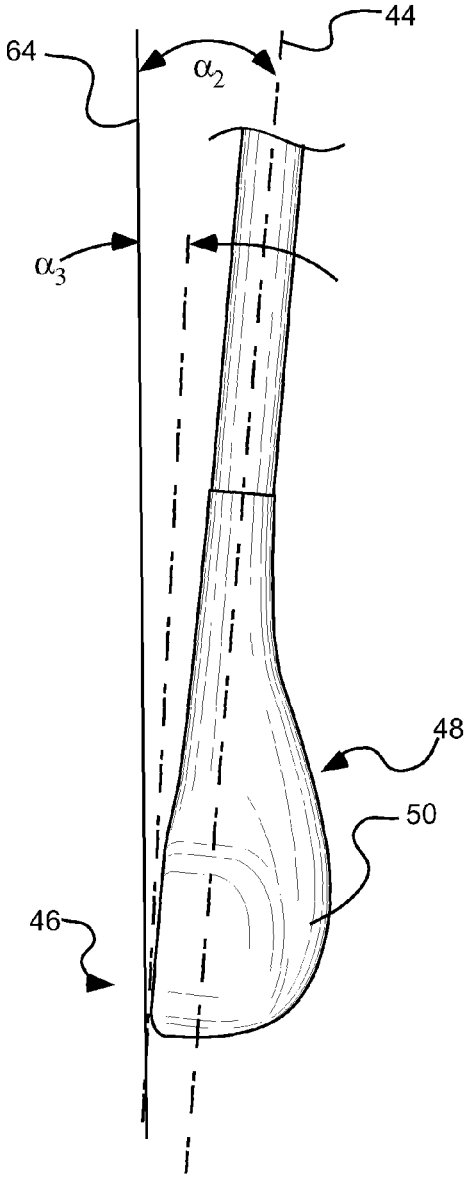
FIG. 10 is a heel-end view of the embodiment of FIG. 5.

FIGS. 8 and 10 illustrate some exemplary alignments with which the shaft axis 44 can be arranged relative to the putter head 4*a*. In one example, the shaft axis 44 and the spine support 50 are aligned at an angle $\alpha_1$ (FIG. 8) of between about 12 degrees and about 20 degrees, relative to a vertical axis 63 orthogonal to a bottom surface of the putter head. In one embodiment, the angle $\alpha_1$ can be about 17 degrees.

In one aspect of the invention, shown in FIG. 10, the shaft axis 44 and the spine support 50 are aligned at an angle $\alpha_2$ of between about 3 degrees and about 7 degrees, relative to a vertical plane 64 aligned with the front face 46 of the putter head. While not so required, the face 46 of the putter can be aligned at an angle $\alpha_3$ of between about 0 degrees to about 3 degrees (e.g., the putter can have a loft from about 0 to about 3 degrees). In one embodiment, the loft is established at about 2 degrees.

While the putter head 4*a* can be formed in a variety of sizes, in the embodiment shown in FIG. 8, height $H_1$ can be about one inch and height $H_2$ can be about four inches. These values are provided as exemplary only, as one of ordinary skill in the art, having possession of this disclosure, will readily appreciate that the putter head size can be varied.

While the invention has been described with reference to certain preferred embodiments, those skilled in the art will appreciate that various modifications, changes, omissions, and substitutions can be made without departing from the spirit of the invention. It is therefore intended that the invention be limited only by the scope of the appended claims.

The invention claimed is:

1. A golf putter, comprising:

an elongated putter shaft; and a putter head attached at or near an end of the putter shaft, the putter head including:

an attachment interface for attachment to the putter shaft, the attachment interface defining a shaft axis with which the shaft is aligned when attached to the putter head;

a front face suitable to strike a golf ball; and a rear face, oriented opposite the front face;

the rear face including a spine support, coupled to or formed integrally therewith, the spine support having a substantially continuous curvature;

the spine support gradually decreasing in depth, relative to the front face, across the rear face in directions orthogonal to the putter shaft axis; wherein a weight distribution plane is defined parallel to and collinear with the shaft axis, and wherein an overall depth of the putter head is substantially constant from heel to toe of the putter forward of the weight distribution plane, and gradually increases from the heel of the putter to the apex and gradually decreases from the apex to the toe of the putter rearward of the weight distribution plane.

2. The putter of claim 1, wherein the spine support includes an apex, and wherein the spine support gradually decreases in depth, relative to the front face, across the rear face from the apex in directions upward and downward from the apex.

3. The golf putter of claim 1, wherein the spine support is concave along all points extending across the rear face radially outward from the apex.

4. The golf putter of claim 1, wherein the apex is a rounded peak.

5. The golf putter of claim 1, wherein substantially all of the spine support is disposed rearward of a plane oriented parallel to the front face and collinear with the shaft axis.

6. The golf putter of claim 1, wherein the shaft axis and the spine support are aligned at an angle of between about 12 degrees and about 20 degrees, relative to a vertical axis orthogonal to a bottom surface of the putter head.

7. The golf putter of claim 1, wherein the shaft axis and the spine support are aligned at an angle of between about 3 degrees and about 7 degrees, relative to a vertical plane aligned with the front face of the putter head.

8. A golf putter, comprising:

an elongated putter shaft; and a putter head operable to be attached at or near an end of the putter shaft, the putter head including:

an attachment interface for attachment to the putter shaft, the attachment interface defining a shaft axis with which the shaft is aligned when attached to the putter head;

a front face suitable to strike a golf ball; and a rear face, oriented opposite the front face;

the rear face including a spine support, coupled to or formed integrally therewith, the spine support having a substantially continuous curvature;

the spine support gradually decreasing in depth, relative to the front face, across the rear face in directions orthogonal to the putter shaft axis; wherein the spine support includes an apex, and wherein the spine support gradually decreases in depth, relative to the front face, across the rear face from the apex in directions upward and downward from the apex.

9. The golf putter of claim 8, wherein the spine support is concave along all points extending across the rear face radially outward from the apex.

10. The golf putter of claim 8, wherein the apex is a rounded peak.

11. The golf putter of claim 8, wherein substantially all of the spine support is disposed rearward of a plane oriented parallel to the front face and collinear with the shaft axis.

12. The golf putter of claim 8, wherein a weight distribution plane is defined parallel to and collinear with the shaft axis, and wherein an overall depth of the putter head is substantially constant from heel to toe of the putter forward of the weight distribution plane, and gradually and constantly increases from the heel of the putter to the apex and gradually and constantly decreases from the apex to the toe of the putter rearward of the weight distribution plane.

13. A golf putter head, comprising:

a putter head operable to be attached at or near an end of a putter shaft, the putter head including:

an attachment interface for attachment to the putter shaft, the attachment interface defining a shaft axis with which the shaft is aligned when attached to the putter head;

a front face suitable to strike a golf ball; and a rear face, oriented opposite the front face;

the rear face including a spine support, coupled to or formed integrally therewith, the spine support having a substantially continuous curvature; wherein the spine support gradually decreasing in depth, relative to the front face, across the rear face in directions orthogonal to the putter shaft axis; and the spine support including an apex, and wherein the spine support gradually decreases in depth, relative to the front face, across the rear face from the apex in directions upward and downward from the apex.

14. The golf putter head of claim 13, wherein the spine support is concave along all points extending across the rear face radially outward from the apex.

15. The golf putter head of claim 13, wherein the apex is rounded.

16. The golf putter head of claim 13, wherein substantially all of the spine support is disposed rearward of a plane oriented parallel to the front face and collinear with the shaft axis.

17. The golf putter of claim 13, wherein a weight distribution plane is defined parallel to and collinear with the shaft axis, and wherein an overall depth of the putter head is substantially constant from heel to toe of the putter forward of the weight distribution plane, and gradually and constantly increases from the heel of the putter to the apex and gradually and constantly decreases from the apex to the toe of the putter rearward of the weight distribution plane.

* * * * *